US012616881B2

(12) United States Patent
Kato

(10) Patent No.: US 12,616,881 B2
(45) Date of Patent: May 5, 2026

(54) GOLF CLUB HEAD

(71) Applicant: SUMITOMO RUBBER INDUSTRIES, LTD., Kobe (JP)

(72) Inventor: Masatoshi Kato, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 15/173,278

(22) Filed: Jun. 3, 2016

(65) Prior Publication Data

US 2016/0354656 A1 Dec. 8, 2016

(30) Foreign Application Priority Data

Jun. 5, 2015 (JP) ..... 2015-115330

(51) Int. Cl.
*A63B 53/04* (2015.01)

(52) U.S. Cl.
CPC ..... *A63B 53/0466* (2013.01); *A63B 53/0408* (2020.08); *A63B 53/0416* (2020.08); *A63B 53/0433* (2020.08); *A63B 53/0458* (2020.08)

(58) Field of Classification Search
CPC ..... A53B 53/0466; A53B 53/04; A53B 53/06; A53B 2053/042; A53B 2053/0408;
(Continued)

(56) References Cited

U.S. PATENT DOCUMENTS 4,489,945 A * 12/1984 Kobayashi ..... A63B 53/0466 473/346
5,954,596 A * 9/1999 Noble ..... A63B 53/02 473/346

(Continued)

FOREIGN PATENT DOCUMENTS

JP 59-19165 U 2/1984
JP 1-166782 A 6/1989

(Continued)

OTHER PUBLICATIONS

Clubhead Cup Face and How it Affects Performance, by Tom Wishon, http://wishongolf.com/the-clubhead-cup-face-and-how-it-affects-performance/, May 2012.*

(Continued)

*Primary Examiner* — William M Pierce
(74) *Attorney, Agent, or Firm* — Birch, Stewart, Kolasch & Birch, LLP

(57) ABSTRACT

Provided is a golf club head in which the restitution performance of a lower part of the face portion can be improved. The golf club head of the invention includes a head body having a crown portion, a sole portion and an opening surrounded by the crown portion and the sole portion, and a face member closing the opening of the head body. The face member is formed in a cup shape having a tabular face portion for hitting the ball and a peripheral portion extending from a periphery of the face portion and joined to an end surface of the opening. The peripheral portion includes a first peripheral region joined to the crown portion and a second peripheral region joined to the sole portion. The second peripheral region is more than 1.6 times larger in width than the first peripheral region, and has a width larger than 8 mm.

14 Claims, 4 Drawing Sheets

(58) Field of Classification Search
CPC .... A53B 2053/0425; A53B 2053/0433; A53B 2053/0437; A53B 2053/0458; A53B 2053/0491
See application file for complete search history.

(56) References Cited

U.S. PATENT DOCUMENTS 6,106,412 A * 8/2000 Kosugi ..... A63B 53/02 473/305
6,368,234 B1 * 4/2002 Galloway ..... A63B 60/00 473/349
6,381,828 B1 * 5/2002 Boyce ..... A63B 53/04 29/527.4
6,491,592 B2 * 12/2002 Cackett ..... A63B 53/0466 473/345
6,582,323 B2 * 6/2003 Soracco ..... A63B 53/02 473/329
6,602,149 B1 * 8/2003 Jacobson ..... A63B 53/04 473/329
6,719,645 B2 * 4/2004 Kouno ..... A63B 53/0466 473/345
6,986,715 B2 * 1/2006 Mahaffey ..... A63B 53/04 473/305
7,226,366 B2 * 6/2007 Galloway ..... A63B 53/0466 473/332
7,285,060 B2 * 10/2007 Williams ..... A63B 53/0466 473/407
7,390,271 B2 * 6/2008 Yamamoto ..... A63B 53/0466 473/345
7,435,191 B2 * 10/2008 Tateno ..... A63B 60/02 473/346
7,762,909 B2 * 7/2010 Sugimoto ..... A63B 53/0466 473/346
7,798,915 B2 * 9/2010 Matsunaga ..... A63B 53/0466 473/329
7,819,758 B2 * 10/2010 Matsunaga ..... A63B 53/0466 473/345
8,109,842 B2 * 2/2012 Matsunaga ..... A63B 53/0466 473/345
8,182,365 B2 * 5/2012 Wada ..... A63B 53/0466 473/344
8,435,137 B2 * 5/2013 Hirano ..... A63B 53/0466 473/345
8,574,095 B2 * 11/2013 Hirano ..... A63B 53/0466 473/345
8,647,217 B2 * 2/2014 Nishio ..... A63B 53/04 473/345
8,678,948 B2 * 3/2014 Wada ..... A63B 53/0466 473/332
8,727,908 B2 * 5/2014 Goto ..... A63B 53/04 473/329
8,734,265 B2 * 5/2014 Soracco ..... A63B 53/0466 473/245
8,888,607 B2 * 11/2014 Harbert ..... A63B 60/52 473/307
9,211,448 B2 * 12/2015 Bezilla ..... A63B 53/06
9,662,545 B2 * 5/2017 Beach ..... A63B 60/52
9,675,850 B2 * 6/2017 Bennett ..... A63B 53/06
9,700,765 B2 * 7/2017 Frame ..... A63B 53/0466
9,802,086 B2 * 10/2017 Kato ..... A63B 53/0466
10,065,082 B2 * 9/2018 James ..... A63B 53/0466
10,155,138 B2 * 12/2018 Mizutani ..... A63B 53/0466
2001/0055995 A1 * 12/2001 Cackett ..... A63B 53/04 473/342
2002/0142861 A1 * 10/2002 Helmstetter ..... A63B 53/02 473/342
2003/0100381 A1 * 5/2003 Murphy ..... A63B 53/02 473/342
2004/0014534 A1 * 1/2004 Hocknell ..... A63B 60/02 473/349
2005/0003903 A1 * 1/2005 Galloway ..... A63B 53/02 473/342
2005/0020379 A1 * 1/2005 Kumamoto ..... A63B 53/0466 473/332
2005/0026714 A1 * 2/2005 Stevens ..... A63B 53/02 473/329
2005/0026722 A1 * 2/2005 Imamoto ..... A63B 53/0466 473/345
2005/0064955 A1 * 3/2005 Soracco ..... A63B 53/02 473/345
2005/0119068 A1 * 6/2005 Onoda ..... A63B 53/0466 473/345
2005/0124436 A1 * 6/2005 Kakiuchi ..... A63B 53/0466 473/345
2005/0192117 A1 * 9/2005 Knuth ..... A63B 60/00 473/342
2005/0215350 A1 * 9/2005 Reyes ..... A63B 53/0466 473/344
2005/0266933 A1 * 12/2005 Galloway ..... A63B 53/0466 473/342
2006/0073910 A1 * 4/2006 Imamoto ..... A63B 53/0466 473/345
2006/0217216 A1 * 9/2006 Lizuka ..... A63B 53/0466 473/349
2007/0010350 A1 * 1/2007 Murphy ..... A63B 53/0466 473/349
2007/0049405 A1 * 3/2007 Tateno ..... A63B 53/0466 473/345
2007/0054751 A1 * 3/2007 Breier ..... A63B 53/04 473/334
2007/0207877 A1 * 9/2007 Nishio ..... A63B 53/0466 473/345
2008/0009369 A1 * 1/2008 Yokota ..... A63B 60/00 473/349
2008/0058119 A1 * 3/2008 Soracco ..... A63B 53/04 473/350
2008/0096688 A1 * 4/2008 Yokota ..... A63B 53/0466 473/345
2008/0182681 A1 * 7/2008 Yokota ..... A63B 53/0466 473/345
2008/0214323 A1 * 9/2008 Chen ..... A63B 53/0466 473/349
2008/0234067 A1 * 9/2008 Lo ..... A63B 53/047 473/350
2009/0253533 A1 * 10/2009 Hirano ..... A63B 53/0466 473/345
2009/0286618 A1 * 11/2009 Beach ..... A63B 53/0466 473/307
2009/0291775 A1 * 11/2009 Hirano ..... A63B 53/0466 473/345
2010/0035700 A1 * 2/2010 Yu ..... A63B 53/02 473/288
2010/0035701 A1 * 2/2010 Kusumoto ..... A63B 53/02 473/307
2010/0048325 A1 * 2/2010 Tanimoto ..... A63B 60/02 473/346
2010/0120552 A1 * 5/2010 Sander ..... A63B 53/0466 473/307
2010/0120556 A1 5/2010 Yamamoto et al.
2010/0304888 A1 * 12/2010 Hirano ..... A63B 53/0466 473/348
2010/0317455 A1 * 12/2010 Cox ..... A63B 53/02 473/314
2011/0165961 A1 * 7/2011 Cackett ..... A63B 53/06 473/282
2012/0021849 A1 * 1/2012 Gibbs ..... A63B 53/0466 473/342
2012/0034991 A1 * 2/2012 Hartwell ..... A63B 53/047 473/290
2012/0071258 A1 * 3/2012 Yamaguchi ..... A63B 53/00 473/287
2012/0129627 A1 * 5/2012 Hirano ..... A63B 53/0466 473/346
2012/0157229 A1 * 6/2012 Takechi ..... A63B 53/0466 473/345
2012/0172147 A1 * 7/2012 McDonnell ..... A63B 53/0466 473/346

(56) References Cited

U.S. PATENT DOCUMENTS

2012/0202615 A1* 8/2012 Beach ..... A63B 53/06 473/345
2012/0289360 A1* 11/2012 Breier ..... A63B 53/047 473/335
2013/0053168 A1* 2/2013 Jertson ..... A63B 53/02 473/309
2013/0085010 A1* 4/2013 Beach ..... A63B 53/02 473/307
2013/0109500 A1* 5/2013 Boyd ..... A63B 53/047 473/332
2013/0116065 A1* 5/2013 Yamamoto ..... A63B 53/0466 473/345
2013/0178305 A1* 7/2013 Beno ..... A63B 53/06 473/287
2013/0225306 A1* 8/2013 David ..... A63B 53/04 473/251
2013/0281229 A1* 10/2013 Su ..... A63B 53/0466 473/349
2013/0331201 A1* 12/2013 Wahl ..... A63B 53/0475 473/329
2013/0331203 A1* 12/2013 Takahashi ..... A63B 60/02 473/345
2014/0038745 A1* 2/2014 Abe ..... A63B 53/0466 473/330
2014/0080634 A1* 3/2014 Golden ..... A63B 60/00 473/345
2014/0106903 A1* 4/2014 Nakamura ..... A63B 60/54 473/346
2014/0121035 A1* 5/2014 Nivanh ..... A63B 53/00 473/309
2014/0162807 A1* 6/2014 Touchette ..... A63B 53/02 473/314
2014/0206472 A1* 7/2014 Aguayo ..... B23K 26/0006 473/331
2015/0031468 A1* 1/2015 Matsunaga ..... A63B 53/0466 473/299
2015/0045143 A1* 2/2015 Abe ..... A63B 53/0466 473/330
2015/0045147 A1* 2/2015 Abe ..... A63B 60/00 473/345
2015/0111658 A1* 4/2015 Yamaguchi ..... A63B 53/00 473/306
2015/0360091 A1* 12/2015 Ban ..... A63B 53/0466 473/331
2015/0367188 A1* 12/2015 Mizutani ..... A63B 53/02 473/309
2015/0375068 A1* 12/2015 Mizutani ..... A63B 53/0466 473/324
2016/0008677 A1* 1/2016 Kitagawa ..... A63B 53/0466 473/331
2016/0008678 A1* 1/2016 Kitagawa ..... A63B 53/0466 473/331
2016/0096082 A1* 4/2016 Boggs ..... A63B 53/04 473/324
2016/0166893 A1* 6/2016 Akiyama ..... A63B 53/0466 473/335
2016/0184666 A1* 6/2016 Mizutani ..... A63B 53/0466 473/342
2016/0250534 A1* 9/2016 Solheim ..... A63B 60/50 473/346
2016/0346654 A1* 12/2016 Franklin ..... A63B 53/0466
2017/0128788 A1* 5/2017 Yamaguchi ..... A63B 53/00
2017/0333762 A1* 11/2017 Jertson ..... A63B 53/0466
2017/0333766 A1* 11/2017 Ban ..... A63B 53/0466
2018/0133566 A1* 5/2018 Kitagawa ..... A63B 53/0466
2018/0154224 A1* 6/2018 Bovee ..... A63B 53/0466
2018/0178091 A1* 6/2018 Mizutani ..... A63B 53/0466
2019/0015713 A1* 1/2019 Kato ..... A63B 53/0466
2019/0046845 A1* 2/2019 Greensmith ..... A63B 53/0466
2019/0091526 A1* 3/2019 Bacon ..... A63B 53/0466

FOREIGN PATENT DOCUMENTS

JP 2003-144590 A 5/2003
JP 2005-6698 A 1/2005
JP 2005-46507 A 2/2005
JP 2006-305170 A 11/2006
JP 2010-115334 A 5/2010
JP 2010-273804 A 12/2010
JP 2014-79447 A 5/2014

OTHER PUBLICATIONS

Effect of Plate Thickness on Mechanical Properties of Steel Arc Welded Joints, Science Direct Materials and Design, https://www.sciencedirect.com/science/article/pii/0261306994900434. 1994.*
Notification of Reasons for Rejection, Office Action for Japanese Application No. 2015-115330, dispatched on Oct. 20, 2015.
Notification of Reasons for Rejection, Office Action for Japanese Application No. 2015-115330, dispatched on Sep. 1, 2015.

* cited by examiner

Cross-section E1

GOLF CLUB HEAD

CROSS REFERENCE TO RELATED APPLICATION

This application claims a priority to Japanese Patent Application No. 2015-115330 filed on Jun. 5, 2015, which is hereby incorporated by reference in its entirety.

FIELD OF INVENTION

The present invention relates to a golf club head.

BACKGROUND OF THE INVENTION

Wood-type golf club heads have heretofore undergone many improvements, and various proposals have been made in order to increase carry distance. For example, there are golf club heads that employ a face portion having a so-called cup face structure, such as shown in JP 2005-6698A. Specifically, the head is constituted by a head body in which an opening is formed and a face member that closes the opening of the head body, and the face member is formed in a cup shape having a tabular face portion and a peripheral portion that extends from the periphery of the face portion. When such a peripheral portion is provided in the face member, the effects of improved restitution performance and increased carry distance are obtained as a result of the flexure of the peripheral portion when the ball is hit.

Incidentally, with fairway woods and clubs such as utilities, a ball arranged directly on the ground is hit, often resulting in the ball being hit with a lower part of the face portion. Thus, there are calls for clubs having high restitution performance even in a lower part of the face portion. The present invention was made in order to solve the above problem, and an object of the invention is to provide a golf club head in which the restitution performance of a lower part of the face portion can be improved.

SUMMARY OF INVENTION

A golf club head according to the present invention includes a golf club head body having a crown portion and a sole portion and having an opening surrounded by the crown portion and the sole portion, and a face member closing the opening of the golf club head body. The face member is formed in a cup shape having a tabular face portion that hits a ball and a peripheral portion that extends from a periphery of the face portion and is joined to an end surface of the opening. The peripheral portion includes a first peripheral region joined to the crown portion and a second peripheral region joined to the sole portion, with a width of the second peripheral region being more than 1.6 times larger than a width of the first peripheral region. The width of the second peripheral region is larger than 8 mm.

The above golf club head can be configured such that the width of the second peripheral region is 1.8 or more times larger than the width of the first peripheral region.

Each of the above golf club heads can be configured such that a thick-walled portion is formed in an inner wall surface of the sole portion, the thick-walled portion is thicker than the second peripheral region, a distance in a face-back direction between the thick-walled portion and the second peripheral region is 10 mm or less, and a ratio F2/F1 is 1.25 to 10.0, where F1 is a height of the thick-walled portion from a undersurface of the sole portion, and F2 is a maximum length of the thick-walled portion in the face-back direction.

Each of the above golf club heads can be configured such that an end surface of the peripheral portion of the face member and the end surface of the opening of the golf club head body joined thereto are substantially the same thickness, and are joined by welding.

Each of the above golf club heads can be configured such that an end surface of the first peripheral region of the face member is thicker than the end surface of the opening at the crown portion of the head body.

A golf club head according to an one aspect of embodiment enables the restitution performance of a lower part of the face portion to be improved.

DETAILED DESCRIPTION OF THE PREFERRED EMBODIMENTS

Figure 1:
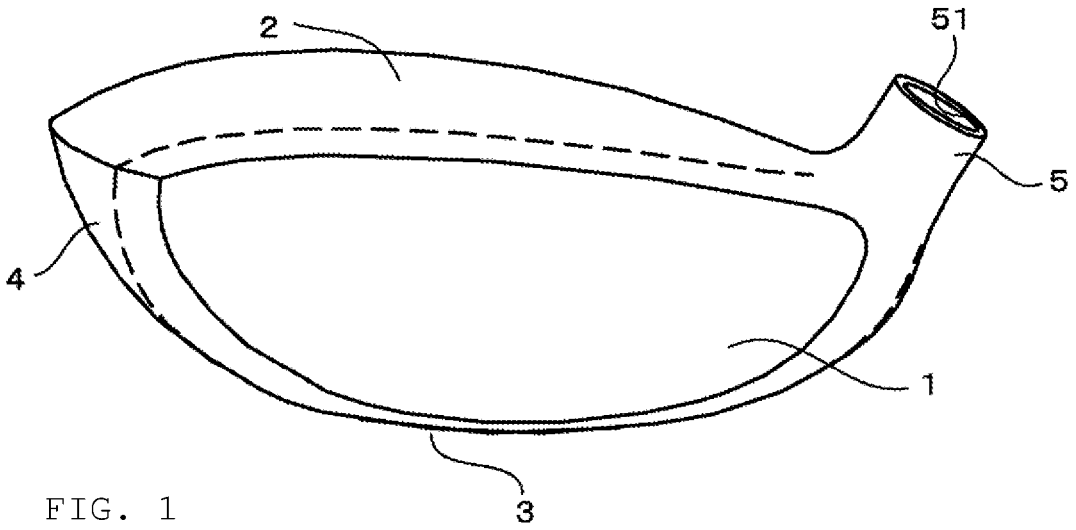
FIG. 1 is a perspective view of a reference state of a golf club head according to an embodiment.
Figure 2:
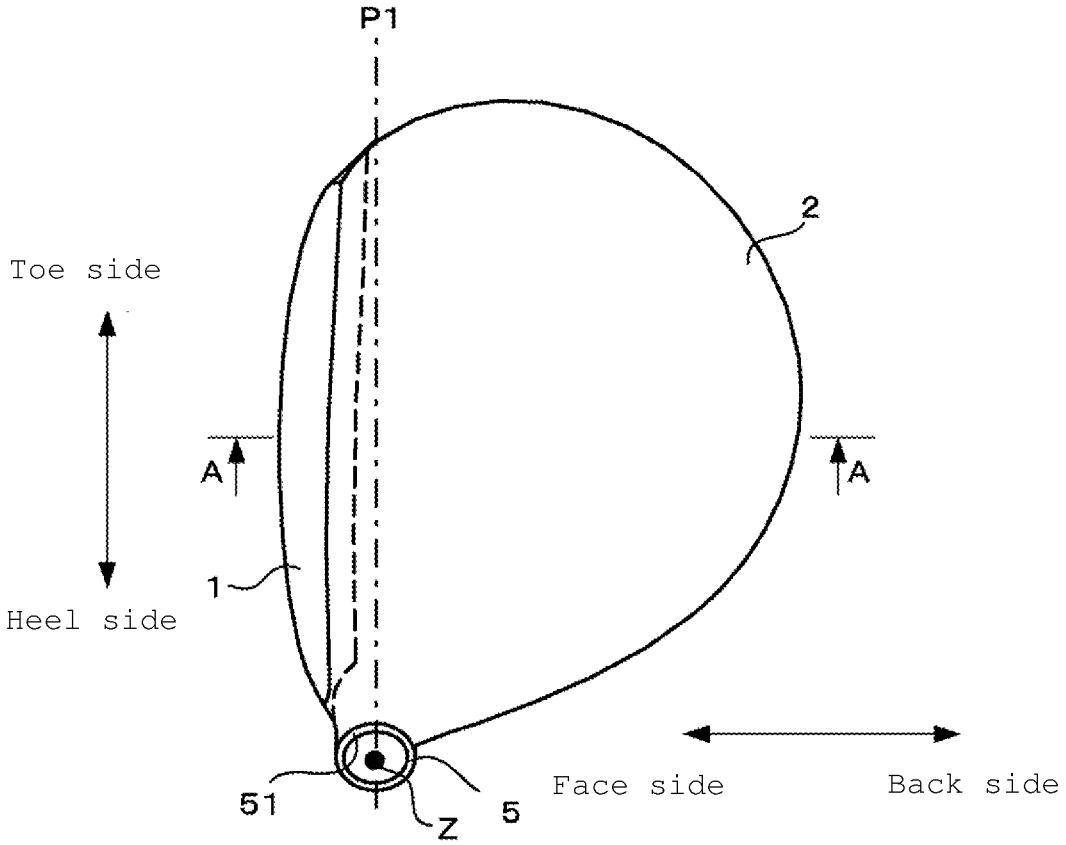
FIG. 2 is a plan view of FIG. 1.

Hereinafter, one embodiment of a golf club head according to the present invention will be described, with reference to the drawings. FIG. 1 is a perspective view of a reference state of a golf club head according to the present embodiment, and FIG. 2 is a plan view of FIG. 1. Note that the reference state of the golf club head will be discussed later.

1. Overview of Golf Club Head

As shown in FIG. 1, the golf club head according to the present embodiment (hereinafter, may be simply referred to as the "head") is a wood-type golf club head having a hollow structure and wall surfaces formed by a face portion 1, a crown portion 2, a sole portion 3, a side portion 4, and a hosel portion 5.

The face portion 1 is the surface that hits the ball, and the crown portion 2 is adjacent to the face portion 1 and constitutes the upper surface of the head. The sole portion 3 constitutes the bottom surface of the head, and is adjacent to the face portion 1 and the side portion 4. A weight member (illustration omitted) is arranged in the sole portion 3. Also, the side portion 4 is the region between the crown portion 2 and the sole portion 3, and extends from the toe side of the face portion 1 to the heel side of the face portion 1 across the back side of the head. Furthermore, the hosel portion 5 is the region that is provided adjacent to the heel side of the crown portion 2, and has an insertion hole 51 for the shaft (illustration omitted) of the golf club to be inserted. A central axis Z of this insertion hole 51 coincides with the axis of the shaft.

Here, the above-mentioned reference state will be described. First, as shown in FIG. 2, a state in which the central axis Z is in a plane P1 that is perpendicular to a horizontal surface H (placement surface; see FIG. 5) and the head is placed on the horizontal surface H at a predetermined lie angle and real loft angle is prescribed as the reference state. The plane P1 will be referred to as a reference vertical plane P1. Also, as shown in FIG. 2, the direction of the line of intersection of the reference vertical plane P1 and the horizontal surface H will be referred to as the toe-heel direction, and the direction that is perpendicular to the toe-heel direction and parallel to the horizontal surface H will be referred to as the face-back direction.

Figure 3A:
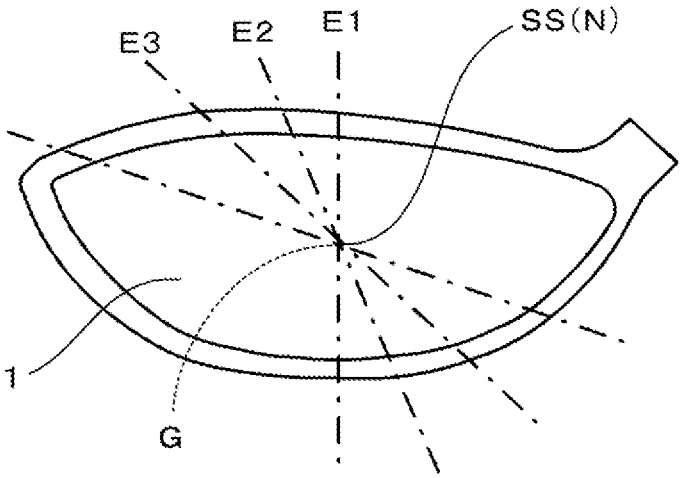
FIGS. 3A and 3B are diagrams illustrating a boundary of a face portion.
Figure 3B:
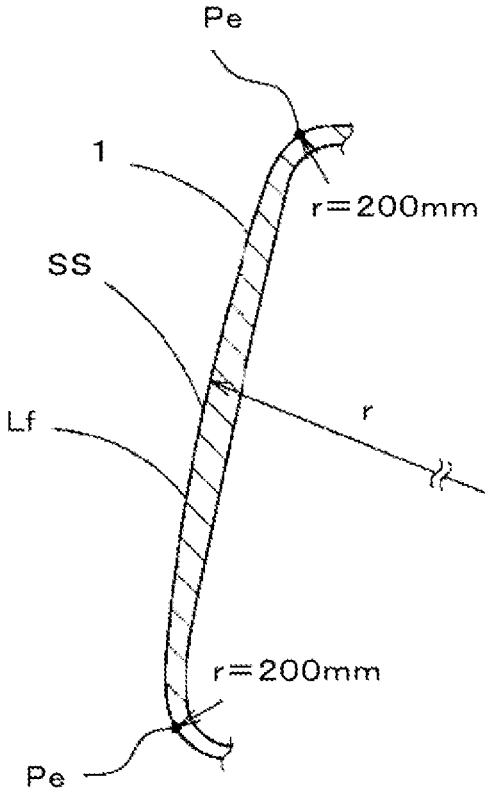

In the present embodiment, the boundary between the crown portion 2 and the side portion 4 can be defined as follows. That is, if a ridge line is formed between the crown portion 2 and the side portion 4, that ridge line serves as the boundary. In contrast, if a clear ridge line is not formed, the outline that is seen when the head is placed in the reference state and viewed from directly above the center of gravity of the head serves as the boundary. This similarly applies to the boundary between the crown portion 2 and the face portion 1, and thus if a ridge line is formed, that ridge line serves as the boundary. However, if a clear ridge line is not formed, positions Pe where, in cross-sections E1, E2, E3 and so on that include a straight line N connecting a center of gravity G of the head and a sweet spot SS, as shown in FIG. 3A, for example, a radius of curvature r of an outline Lf of the outer surface of the face first reaches 200 mm when moving outward from the sweet spot side, as shown in FIG. 3B, is defined as the peripheral edge (boundary) of the face portion 1. Note that the sweet spot SS is the intersection between the face surface and the normal (straight line N) of the face surface that passes through the center of gravity G of the head.

Also, in the present embodiment, the boundary between the sole portion 3 and the face portion 1 and between the sole portion 3 and the side portion 4 can be defined as follows. That is, if a ridge line is formed between the sole portion 3 and the face portion 1 and between the sole portion 3 and the side portion 4, that ridge line serves as the boundary. Also, although the golf club head according to the present embodiment has the side portion 4, in cases such as where, for example, the side portion is not provided, the side portion 4 cannot be clearly distinguished and is included in the sole portion, or the sole portion 3 is directly connected to the crown portion 2, the ridge line between the sole portion 3 and the crown portion 2 serves as the boundary between both portions. Also, if a clear ridge line is not formed, the outline that is seen when the head is placed in the reference state and viewed from directly above the center of gravity of the head serves as the boundary. Note that, in consideration also of the case where the side portion cannot be clearly distinguished as described above, the "sole portion" according to the present invention is deemed to include the side portion.

The volume of this golf club head is, for example, preferably 90 $cm^3$ or more, and more preferably 100 $cm^3$ or more. A head having such a volume serves to make the golfer feel more confident when the club is held at address, and also to increase the sweet spot area and the moment of inertia. Note that although an upper limit of the head volume is not particularly defined, it is desirably 460 $cm^3$ or less in the case of complying with R&A and USGA rules and regulations.

Also, the head can be formed from, for example, maraging steel having a specific gravity of approximately 7.7 to 7.8. Apart from maraging steel, the head can also be formed using one or a plurality of materials selected from among stainless steel, a titanium alloy, an aluminum alloy, a magnesium alloy, an amorphous alloy, and the like.

2. Assembly Structure of Golf Club Head

Figure 4:
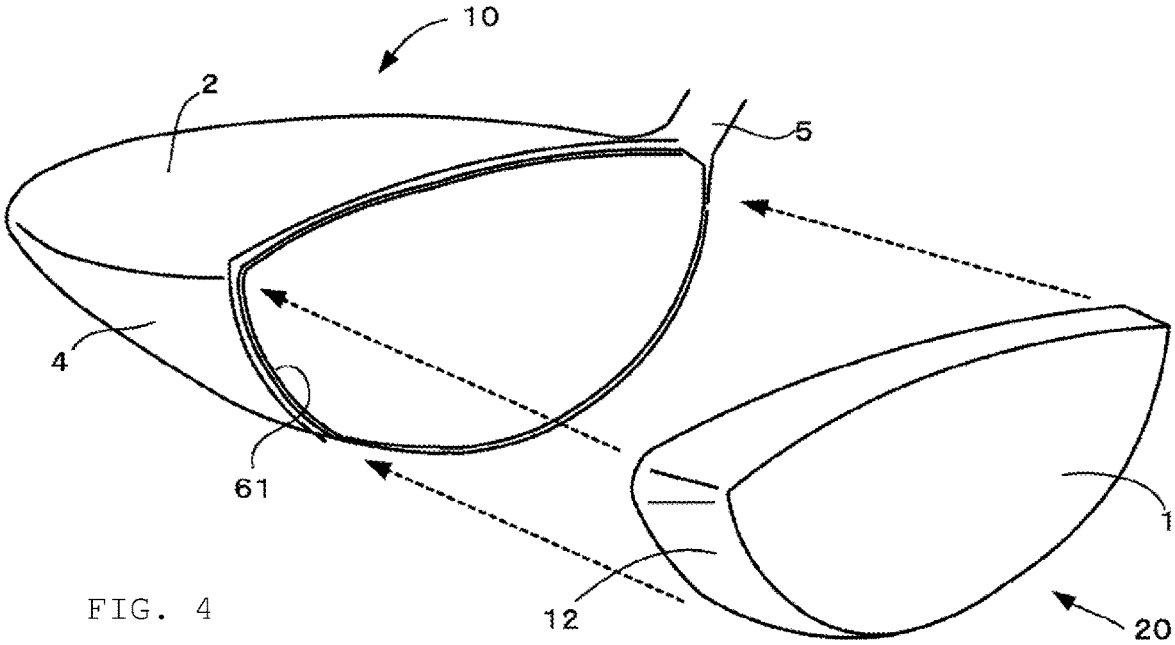
FIG. 4 is a perspective view illustrating assembly of the golf club head shown in FIG. 1.

The head according to the present embodiment is, as shown in FIG. 4, constituted by assembling a head body 10 having the crown portion 2, the sole portion 3 and the side portion 4 and a face member 20 formed in a cup shape that has the face portion 1 and a peripheral portion 12 extending from the periphery of the face portion 1. This head body 10 has an opening surrounded by the crown portion 2, the sole portion 3 and the side portion 4, and the face member 20 is attached so as to close this opening. That is, the end surface of the peripheral portion 12 of the face member 20 is butted against the end surface of the opening 61, and these two portions are joined by welding as will be discussed later. The face member 20, by being attached to the opening of the head body 10, is integrated with the head body 10, and the peripheral portion 12 of the face member 20 thereby functions as a part of the crown portion 2, the sole portion 3, and the side portion 4. Accordingly, the surfaces that are integrally formed by the peripheral portion 12 of the face member 20 being attached to the head body 10 constitute the crown portion 2, the sole portion 3, and the side portion 4. Although the various portions of the head body 10 are thus, strictly speaking, a part of these surfaces, the portions of the head body 10 may be referred to below as the crown portion 2, the sole portion 3 and the side portion 4, without making this distinction.

3. Structure of Face Member

Figure 5:
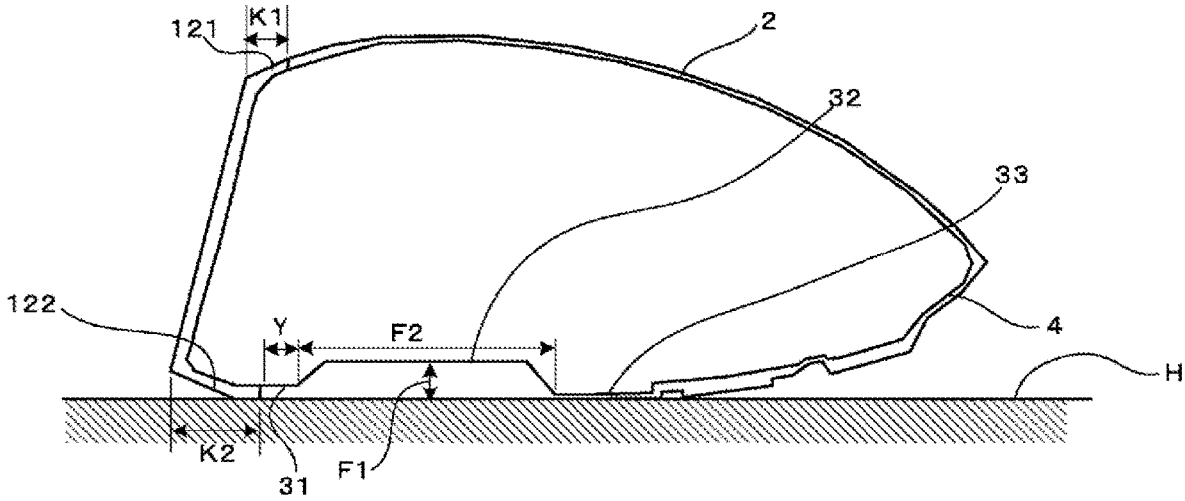
FIG. 5 is a cross-sectional view taken along the line A-A in FIG. 2 (cross-section passing through a face center)

Next, the peripheral portion 12 of the face member 20 will be described, with reference to FIG. 5. FIG. 5 is a cross-sectional view taken along the line A-A in FIG. 2, or in other words, a cross-section taken along a vertical plane passing through the center of the face (plane perpendicular to the above-mentioned horizontal surface H; the same applies below). The center of the face is defined as a point within the face portion 1 that satisfies the condition that the horizontal length from that point to a position furthest on the toe side of the face portion 1 is equal to the horizontal length from that point to a position furthest on the heel side of the face portion 1, and the length in the up-down direction from that point to a position furthest on the upper side of the face portion 1 is equal to the length in the up-down direction from that point to a position furthest on the lower side of the face portion 1. As described above, the face member 20 is formed in a cup shape that has the face portion 1 and the peripheral portion 12 extending from the periphery of the face portion 1. A width K1 of the part of the peripheral portion 12 that is joined to the crown portion 2 of the head body 10, or in other words, the protruding length thereof from the face portion 1, is preferably 3 to 8 mm, and is more preferably 4 to 7 mm.

On the other hand, a width K2 of the part of the peripheral portion 12 that is joined to the sole portion 3 of the head body 10 is preferably larger than 8 mm and 15 mm or less, and is more preferably 9 to 12 mm. Hereinafter, the part of the peripheral portion 12 that is joined to the crown portion 2 will be referred to as a first peripheral region 121, and the part that is joined to the sole portion 3 will be referred to as a second peripheral region 122. Also, the widths K1 and K2 of the first peripheral region 121 and the second peripheral region 122 are assumed to be measured by the length in the face-back direction in the case where the head body 10 is cut in a vertical plane passing through the above-mentioned center of the face.

As described above, in the present embodiment, the width K2 of the second peripheral region 122 is larger than the width K1 of the first peripheral region 121, and, in particular, is preferably more than 1.6 times larger, and more preferably 1.8 or more times larger.

4. Structure of Sole Portion

Figure 6:
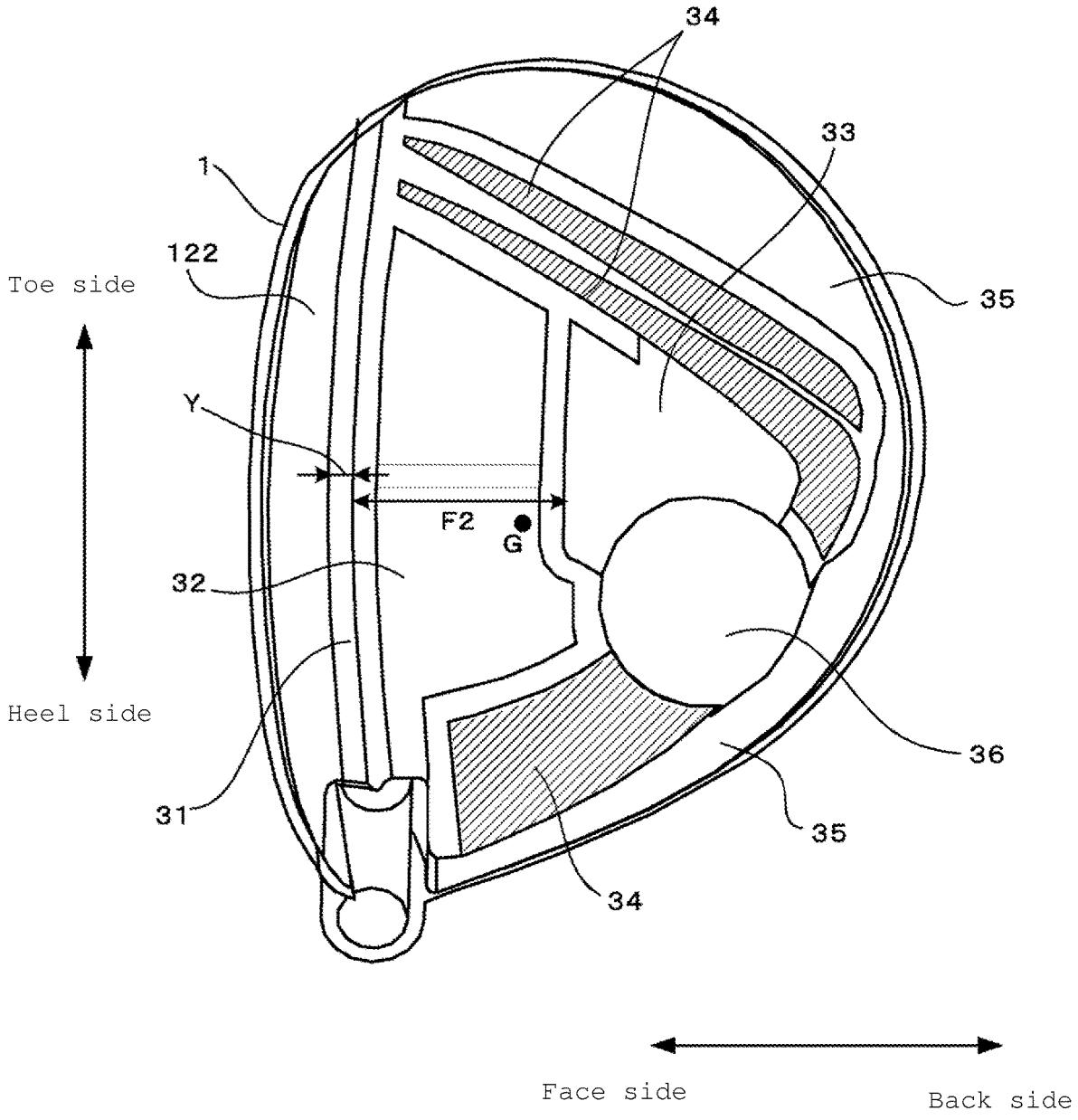
FIG. 6 is a plan view that projects the inner wall surface of a sole portion of the golf club head of FIG. 1.

Next, the sole portion 3 will be described, with reference also to FIG. 6. FIG. 6 is a plan view that penetrates the inner wall surface of the sole portion. As shown in FIGS. 5 and 6, the sole portion 3 is provided with a joining portion 31 that joins to the peripheral portion 12 of the face member 20, and a thick-walled portion 32 that is arranged on the back side of the joining portion 31. Also, a peripheral thick-walled portion 34 arranged so as to surround the frontal thick-walled portion 32 and the central thin-walled portion 33 is provided in the sole portion 3, and a peripheral thin-walled portion 35 is furthermore arranged so as to surround this peripheral thick-walled portion 34. Also, the peripheral thick-walled portion 34 has arranged therein a recessed portion 36 in which the above-mentioned weight member is to be arranged.

The thickness of the joining portion 31 is generally the same as the thickness of the end surface of the peripheral portion 12 of the face member 20, and can, for example, be set from 0.7 to 1.5 mm. The same also applies to the side portion 4 and the crown portion 2. A width Y of the joining portion 31 in the face-back direction is preferably 10 mm or less, and is more preferably 5 mm or less. This is because if the width Y of the joining portion is too long, the frontal thick-walled portion 32 will be arranged further on the back side, possibly resulting in the center of gravity being shifted to the back side. In particular, the SS (sweet spot) height is raised and the ball hitting angle is lowered when the center of gravity shifts to the back side. Conversely, welding is difficult when the width Y of the joining portion is too short, and thus the width Y is preferably 2.5 mm or more.

The frontal thick-walled portion 32 is thicker than the joining portion 31 and is formed to have a rectangular shape in cross-section and so as to extend in the toe-heel direction of the sole portion 3. Also, the center of gravity G of the head that is projected onto the sole portion 3 is located in this frontal thick-walled portion 32. A height F1 of the frontal thick-walled portion 32 from the undersurface of the sole portion 3 is preferably 2.5 to 8.0 mm, and is more preferably 3.0 to 8.0 mm. Also, a width F2 of the frontal thick-walled portion 32 starting from the end portion of the joining portion 31 is preferably 10 to 30 mm, and is more preferably 15 to 25 mm. The width F2 at this time is the maximum length, and is, for example, the length of the lower side when the cross-sectional shape of the frontal thick-walled portion 32 is a trapezoid. Also, a ratio F2/F1 of the height F1 to the width F2 of the frontal thick-walled portion 32 is, for example, preferably 1.25 to 10.0, and more preferably 3.0 to 8.0. Note that the above dimensions F2 and Y are assumed to be measured by the length in the face-back direction in the case where the above-mentioned head body 10 is cut in a vertical plane passing through the center of the face.

The central thin-walled portion 33 that is arranged on the back side of the frontal thick-walled portion 32 is formed to have a substantially triangular shape projecting toward the back side. The peripheral thick-walled portion 34 surrounding the frontal thick-walled portion 32 and the central thin-walled portion 33 is constituted by three portions in the present embodiment, but is formed to be substantially U-shaped as a whole, and the above-mentioned recessed portion 36 is arranged in a part thereof. To be more specific, the peripheral thick-walled portion 34, as a whole, extends from the toe side of the frontal thick-walled portion 32 to the back side along edge portions of the frontal thick-walled portion 32 and the central thin-walled portion 33 on the toe side, and extends via the rear end portion of the central thin-walled portion 33 on the back side to the face side along edge portions of the central thin-walled portion 33 and the frontal thick-walled portion 32 on the sole side. That is, the peripheral thick-walled portion 34 is formed to be substantially U-shaped with both end portions in the vicinity of the face portion 1, and is formed so as to generally increase in width toward the back side. Also, the peripheral thick-walled portion 34 is divided by the recessed portion 36. Furthermore, the substantially U-shaped peripheral thin-walled portion 35 is arranged on the back side of the peripheral thick-walled portion 34, so as to surround this peripheral thick-walled portion 34.

The peripheral thick-walled portion 34 is thinner than the frontal thick-walled portion 32 (the above-mentioned F1), but thicker than the central thin-walled portion 33. For example, the thickness of the central thin-walled portion 33 can be set from 0.4 to 0.8 mm. On the other hand, the thickness of the peripheral thick-walled portion 34 can be set from 1.0 to 6.0 mm. The three portions need not, however, be the same thickness, and need only be at least thicker than the central thin-walled portion 33. The bottom of the recessed portion 36 is also thicker than the thin-walled portion 33, and can be set from 0.8 to 3.0 mm, for example. Furthermore, the peripheral thin-walled portion 35 is about the same thickness as the central thin-walled portion 33, and is thinner than the peripheral thick-walled portion 34.

5. Manufacturing Method

The golf club head configured as described above can be produced with various methods, and can, for example, be manufactured in the following manner. First, the head body 10 can be manufactured by casting such as known lost wax precision casting, for example. On the other hand, the face member 20 can be manufactured by stamping. The head body 10 and the face member 20 are then joined by welding, for example. Thereafter, the golf club head is completed by performing painting and the like.

6. Features

According to the above embodiment, the following effects can be obtained.

(1) With regard to the peripheral portion 12 of the face member 20, the width K2 of the second peripheral region 122 is larger than the width K1 of the first peripheral region 121, and, in particular, is preferably more than 1.6 times larger. Thus, the restitution performance of a lower part of the face portion 1 can be enhanced. Carry distance can also be lengthened in cases such as hitting a ball arranged directly on the ground.

(2) As described above, the thick-walled portion 32 of the sole portion 3 moves to the back side when the width K2 of the second peripheral region 122 is lengthened, possibly resulting in an increase in the SS height. In contrast, in the present embodiment, the width Y of the joining portion 31 of the sole portion 3 is set to 12 mm or less, and the dimensions of the thick-walled portion 32 are furthermore prescribed as described above. In particular, when the ratio F2/F1 of the height F1 and the width F2 of the thick-walled portion 32 is set from 1.25 to 10.0, it is possible to suppress an increase in the height of the center of gravity of the head and to also suppress movement of the center of gravity to the back side. As a result, an increase in the SS height can be suppressed.

(3) Since the peripheral thick-walled portion 34 is formed so as to surround the central thin-walled portion 33, the lateral moment of inertia of the head can be increased. Thus, even in the case where the ball is hit at a position shifted in the toe-heel direction, variation in the hitting conditions, carry distance and directionality can be reduced. In particular, since the center of gravity is above the frontal thick-walled portion 32, the peripheral thick-walled portion 34 is located at a distance from the center of gravity, thereby enabling the lateral moment of inertia to be further increased. Also, since the peripheral thick-walled portion 34 increases in width toward the back side, the lateral moment of inertia can be further increased.

(4) The frontal thick-walled portion 32 and the peripheral thick-walled portion 34 are provided in the sole portion 3, dividing the thick part between two places. Thus, the thick-walled portions 32 and 34 are kept from becoming too thick. The center of gravity can thereby be further lowered.

(5) The peripheral thin-walled portion 35 is provided at a small thickness, around the peripheral thick-walled portion 34. Since the peripheral thick-walled portion 34 is located at a higher position than the central thin-walled portion 33 and the frontal thick-walled portion 32, lowering of the center of gravity can be further achieved by reducing the thickness of such parts that are positioned higher.

7. Variations

Although one embodiment of the present invention has been described above, the invention is not limited to the foregoing embodiment, and various modifications can be made without departing from the spirit of the invention. Note that the following variations can be combined as appropriate.

7.1

In the above embodiment, the joining portion 31 that joins to the second peripheral region 122 is provided in the sole portion 3, and in the case of joining the head body 10 and the peripheral portion 12 of the face member 20 by welding, it is preferable to make the peripheral portion 12 and the joining portion 31 generally the same thickness. On the other hand, the thick-walled portion 32 and the second peripheral region 122 can also be joined directly, without providing the joining portion 31. In such cases where the joining portion 31 is not provided, the peripheral portion 12 of the face member 20 and the end surface of the opening 61 of the head body 10 can be joined using brazing, adhesive, diffusion bonding, or the like. Also, the thickness of other parts of the sole portion 3 is not particularly limited, with the above central thin-walled portion 33, peripheral thick-walled portion 34 and peripheral thin-walled portion 35 being examples, and various thickness distributions can be employed.

7.2

The thick-walled portion 32 of the sole portion 3 is not particularly limited in shape, and can take various forms such as having a rectangular shape, besides being trapezoidal in cross-section as described above.

7.3

In the above embodiment, as shown in FIG. 5, for example, the peripheral portion 12 of the face member 20 and the end surface of the opening of the head body 10 are the same in thickness, but this can also be changed. For example, the peripheral portion 12 can be made thicker than the end surface of the opening.

7.4

The present invention can be applied to golf club heads such as drivers, fairway woods and utilities.

Working Example

Hereinafter, a working example of the present invention will be described. The present invention is, however, not limited to the following working example.

Here, the golf club heads of fairway woods according to one working example and two comparative examples 1 and 2 were produced. The working example had the same configuration as the above embodiment, and was manufactured by joining the face member to the head body. The comparative example 1 differs from the working example in the width of the second peripheral region, but otherwise is the same as the working example. Also, the comparative example 2 is substantially the same mode as the comparative example 1, although the dimensions of the thick-walled portion differ from the comparative example 1. The face members of the working example and the comparative examples 1 and 2 were all formed by stamping HT1770M maraging steel which is a rolled steel material produced by Nisshin Steel Co., Ltd. The head bodies were formed by lost wax precision casting using molten metal made of Custom 450 maraging steel produced by Carpenter Technology Corporation. The working example and comparative examples 1 and 2 all had a maximum head height of 36 mm, a head weight of 215 g, and a head volume of 150 cc. The characteristic dimensions of the working example and the comparative examples 1 and 2 were as follows.

TABLE 1

| | Working Example | Comparative Example 1 | Comparative Example 2 |
|---|---|---|---|
| Width K1 of 1st peripheral region | 5 mm | 5 mm | 5 mm |
| Width K2 of 2nd peripheral region | 10 mm | 8 mm | 8 mm |
| Width Y of joining portion | 3.0 mm | 3.0 mm | 3.0 mm |
| Thickness of joining portion | 1.1 mm (portion corresponding to 1st peripheral region) to 1.4 mm (portion corresponding to 2nd peripheral region) | 1.1 mm (portion corresponding to 1st peripheral region) to 1.4 mm (portion corresponding to 2nd peripheral region) | 1.1 mm (portion corresponding to 1st peripheral region) to 1.4 mm (portion corresponding to 2nd peripheral region) |
| Height F1 of thick-walled portion | 5.3 mm | 5.3 mm | 4.5 mm |
| Width F2 of thick-walled portion | 23.0 mm | 23.0 mm | 27.0 mm |
| Length of thick-walled portion (toe-heel direction) | 60.0 mm | 60.0 mm | 60.0 mm |

The SS height and the coefficient of restitution of a lower part of the face portion (position 5 mm below the center position of the face) was measured for the working example and comparative examples configured as described above.

The height of the SS position when the head was placed in the reference state was measured with a height gauge. The coefficient of restitution was derived in accordance with Procedure for Measuring the Velocity Ratio of a Club Head for Conformance to Rule 4-1e, Revision 2 (Feb. 8, 1999), United States Golf Association (USGA). The results were as shown in table 2.

TABLE 2

| | Working Example | Comparative Example 1 | Comparative Example 2 |
|---|---|---|---|
| SS height | 21.5 mm | 21.4 mm | 22.5 mm |
| Restitution coefficient 5 mm below face center | 0.793 | 0.788 | 0.775 |

According to the above results, the restitution performance of the lower part of the face portion was greater for the working example, compared with the comparative examples 1 and 2, because of the large width K2 of the second peripheral region.

REFERENCE SIGNS LIST

1 Face portion
2 Crown portion
3 Sole portion
10 Head body
31 Joining portion
32 Frontal thick-walled portion (thick-walled portion)

The invention claimed is:

1. A golf club head comprising:

a golf club head body having a crown portion, a sole portion, a face portion, and a hosel portion, and having an opening surrounded by the crown portion and the sole portion; and a face member comprising said face portion, and the face member closing the opening of the golf club head body, wherein:

the face member is formed in a cup shape having the face portion that is tabular and hits a ball and a peripheral portion that extends from a periphery of the face portion and is joined to an end surface of the opening, the peripheral portion includes a first peripheral region joined to the crown portion and a second peripheral region joined to the sole portion, a width K1 of the first peripheral region is defined as the length in the face-back direction in the case where the head body is cut in a vertical plane passing through the center of the face, a width K2 of the second peripheral region is defined as the length in the face-back direction in the case where the head body is cut in a vertical plane passing through the center of the face, the width K2 of the second peripheral region is larger than the width K1 of the first peripheral region, the width K2 is more than 1.6 times larger than the width K1, the width K2 of the second peripheral region is larger than 8 mm, when P1 is defined as a plane that intersects an axis of the hosel portion and extends from the toe-heel direction, the entirety of the first peripheral region is disposed face side from said P1, a frontal thick-walled portion is formed in an inner wall surface of the sole portion, the frontal thick-walled portion is thicker than the second peripheral region, a joining portion is formed between the frontal thick-walled portion and the second peripheral region, a length of the joining portion in a face-back direction is 10 mm or less, and a ratio F2/F1 is 1.25 to 10.0, wherein F1 is a height of the frontal thick-walled portion from a undersurface of the sole portion, and F2 is a maximum length of the frontal thick-walled portion in the face-back direction.

2. The golf club head according to claim 1, wherein a central thin-walled portion is further formed in the inner wall surface of the sole portion, the central thin-walled portion is arranged on the back side than the frontal thick-walled portion and is thinner than the frontal thick-walled portion.

3. The golf club head according to claim 2, wherein a length of the central thin-walled portion in a toe-heel direction is formed so as to decrease toward the back side.

4. The golf club head according to claim 2, wherein at least a part of the central thin-walled portion is placed on a placement surface in a reference state and the remaining portion of the central thin-walled portion inclines upward toward the back side.

5. The golf club head according to claim 1, wherein a peripheral thick-walled portion is further formed in the inner wall surface of the sole portion, the peripheral thick-walled portion surrounds at least part of the frontal thick-walled portion.

6. The golf club head according to claim 5, wherein the peripheral thick-walled portion is thinner than the frontal thick-walled portion.

7. The golf club head according to claim 5, wherein the peripheral thick-walled portion is at least partially larger in width on the heel side than on the toe side.

8. The golf club head according to claim 5, wherein the peripheral thick-walled portion is formed to have a substantially U-shape projecting toward the back side.

9. The golf club head according to claim 5, wherein at least a part of the peripheral thick-walled portion is placed on a placement surface in a reference state and the remaining portion of the peripheral thick-walled portion inclines upward toward the back side.

10. The golf club head according to claim 5, wherein a peripheral thin-walled portion is further formed in the inner wall surface of the sole portion, the peripheral thin-walled portion is arranged on the back side of the peripheral thick-walled portion, so as to surround the peripheral thick-walled portion, and is thinner than the peripheral thick-walled portion.

11. The golf club head according to claim 10, wherein at least a part of the peripheral thin-walled portion is placed on a placement surface in a reference state and the remaining portion of the peripheral thin-walled portion inclines upward toward the back side.

12. The golf club head according to claim 1, wherein an end surface of the peripheral portion of the face member and the end surface of the opening of the golf club head body joined thereto are substantially the same thickness, and are joined by welding.

13. The golf club head according to claim 1, wherein an end surface of the first peripheral region of the face member is thicker than the end surface of the opening at the crown portion of the golf club head body.

14. A golf club head comprising:

a golf club head body having a crown portion, a sole portion and a hosel portion, and having an opening surrounded by the crown portion and the sole portion; and a face member closing the opening of the golf club head body, wherein:

the face member is disposed in a face side other than a surface which passes through an axis of the hosel and extends in a toe-heel direction, the face member is formed in a cup shape having a tabular face portion that hits a ball and a peripheral portion that extends from a periphery of the face portion and is joined to an end surface of the opening, the peripheral portion includes a first peripheral region joined to the crown portion and a second peripheral region joined to the sole portion, a width K1 of the first peripheral region is defined as the length in the face-back direction in the case where the head body is cut in a vertical plane passing through the center of the face, a width K2 of the second peripheral region is defined as the length in the face-back direction in the case where the head body is cut in a vertical plane passing through the center of the face, the width K2 of the second peripheral region is more than 1.6 times larger than the width K1 of the first peripheral region, the second peripheral region increases in width toward a sole portion side from both ends which are joined to the first peripheral region, the width K2 of the second peripheral region is larger than 8 mm, the sole portion includes a joining portion that is joined to the second peripheral region and a frontal thick-walled portion arranged on a back side of the joining portion, the frontal thick-walled portion is thicker than the joining portion and the second peripheral region, and a length of the frontal thick-walled portion in a toe-heel direction decreases toward a back side of the frontal thick-walled portion.

* * * * *